US005851429A

United States Patent [19]

Magyar

[11] Patent Number: 5,851,429

[45] Date of Patent: Dec. 22, 1998

[54] DISPERSIONS OF WAXY POUR POINT DEPRESSANTS

[75] Inventor: James Steven Magyar, Bedford, Ohio

[73] Assignee: The Lubrizol Corporation, Wickliffe, Ohio

[21] Appl. No.: 629,211

[22] Filed: Apr. 8, 1996

Related U.S. Application Data

[60] Provisional application No. 60/007,686 Nov. 25, 1995.

[51] Int. Cl.[6] ..... B01J 13/00; C10L 1/18

[52] U.S. Cl. ..... 252/311; 508/575; 508/587; 44/450

[58] Field of Search ..... 252/311, 314; 508/575, 584, 585, 587; 44/450

[56] References Cited

U.S. PATENT DOCUMENTS

| | | | |
|---|---|---|---|
| 1,637,475 | 8/1927 | Davis et al. | 252/8.81 |
| 2,021,143 | 11/1935 | Calcott et al. | 252/309 |
| 2,296,933 | 8/1942 | Jordan | 252/315.4 |
| 2,598,666 | 6/1952 | Sesso et al. | 106/10 |
| 2,606,874 | 8/1952 | Garner et al. | 252/308 |
| 2,728,684 | 12/1955 | Darragh | 252/311 |
| 3,061,544 | 10/1962 | Marinek | 252/314 |
| 3,393,078 | 7/1968 | Lockhart | 106/8 |
| 3,600,311 | 8/1971 | Naiman et al. | 585/9 |
| 3,658,495 | 4/1972 | Dorer | 44/400 |
| 3,791,984 | 2/1974 | Brogli et al. | 252/308 |
| 3,792,984 | 2/1974 | Cole et al. | 44/393 |
| 3,909,445 | 9/1975 | Ernst | 252/321 |
| 3,974,116 | 8/1976 | Lissant | 252/312 |
| 4,155,719 | 5/1979 | Sweeney | 44/393 |
| 4,369,123 | 1/1983 | Selwitz et al. | 252/312 |
| 4,435,309 | 3/1984 | House | 252/314 |
| 4,435,338 | 3/1984 | Michaelis et al. | 558/165 |
| 4,486,334 | 12/1984 | Horiuchi et al. | 252/312 |
| 4,547,202 | 10/1985 | Miller | 44/393 |
| 4,559,155 | 12/1985 | Dorer, Jr. et al. | 252/73 |
| 4,564,460 | 1/1986 | Dorer, Jr. et al. | 252/73 |
| 4,565,550 | 1/1986 | Dorer, Jr. et al. | 44/331 |
| 4,575,526 | 3/1986 | Dorer, Jr. et al. | 524/96 |
| 4,613,342 | 9/1986 | Dorer, Jr. et al. | 44/334 |
| 4,708,809 | 11/1987 | Davis | 44/450 |
| 4,990,274 | 2/1991 | Nalesnik | 508/241 |
| 5,039,437 | 8/1991 | Martella et al. | 508/572 |
| 5,082,470 | 1/1992 | Martella et al. | 44/304 |
| 5,118,875 | 6/1992 | Martella et al. | 568/727 |
| 5,145,603 | 9/1992 | Paasch et al. | 252/311 |
| 5,451,630 | 9/1995 | Olivier et al. | 524/528 |
| 5,707,946 | 1/1998 | Hiebert et al. | 508/585 |

FOREIGN PATENT DOCUMENTS

| | | |
|---|---|---|
| 311452A2 | 4/1989 | European Pat. Off. . |
| 448166A2 | 9/1991 | European Pat. Off. . |
| 1173975 | 12/1969 | United Kingdom . |
| 1368729 | 10/1974 | United Kingdom . |
| 2189251 | 10/1987 | United Kingdom . |
| 2305437 | 4/1997 | United Kingdom . |
| WO92/07047 | 4/1992 | WIPO . |

OTHER PUBLICATIONS

Perry"S Chemical Engineers" Handbook, McGraw–Hill, NY, NY, Copyright 1984, pp. 8–45 to 8–46.

*Primary Examiner*—Richard D. Lovering
*Assistant Examiner*—Daniel S. Metzmaier
*Attorney, Agent, or Firm*—David M. Shold

[57] ABSTRACT

A liquid pour point depressant composition comprises a pour point depressant which is a solid at room temperature and which has a number average molecular weight of at least 500, and a liquid medium in which the material of pour point depressant is substantially insoluble at room temperature. The pour point depressant component is dispersed in the liquid medium.

16 Claims, No Drawings

DISPERSIONS OF WAXY POUR POINT DEPRESSANTS

This application claims the benefit of U.S. provisional application(s): Ser. No. 60/007,686 filed Nov. 25, 1995.

BACKGROUND OF THE INVENTION

The present invention relates to dispersions of waxy pour point depressants.

Various types of distillate fuel oils such as diesel fuels, various oils of lubricating viscosity, automatic transmission fluids, hydraulic oil, home heating oils, and crude oils require the use of pour point depressant additives in order to allow them to flow freely at lower temperatures. Often kerosene is included in such oils as a solvent for the wax, particularly that present in distillate fuel oils. However, demands for kerosene for use in jet fuel has caused the amount of kerosene present in distillate fuel oils to be decreased over the years. This, in turn, has required the addition of wax crystal modifiers to make up for the lack of kerosene. Moreover, the requirement for pour point depressant additives in crude oils can be even more important, since addition of kerosene is not considered to be economically desirable.

Many pour point depressants are themselves somewhat waxy solid materials, because of the presence of relatively long hydrocarbyl groups. Such materials can be better handled at room temperature if they are in a liquid form, i.e., dissolved or dispersed in some medium.

U.S. Pat. No. 4,435,309, House, Mar. 6, 1984, discloses a method of liquifying materials which are either waxy solids at ambient temperatures or solid or semisolid mixtures of such waxy materials and a solvent therefor. A solution of the waxy material in the solvent is formed at elevated temperatures, the solution is cooled to produce a semi-solid to solid phase, and thereafter the mixture is sheared. Among the waxy materials are quaternary ammonium compounds and polyoxyethylated alkylphenols; among the solvents are mixtures of isopropylamine and water, or hexylene glycol.

U.S. Pat. No. 3,061,544, Martinek, Oct. 30, 1962, discloses a method for preparing colloidal dispersions, by simultaneously lowering the temperature, pressure, and concentration during shearing. The colloid-forming phase is dissolved in a minimum amount of the colloid-bearing phase by applying sufficient heat to produce a solution. The hot, concentrated solution is injected under high pressure through jet or spray nozzled into a zone of lower pressure and lower temperature where the jets or sprays meet or impinge against the balance of the liquid phase, also injected under high pressure.

U.S. Pat. No. 3,393,078, Lockhart et al., Jul. 16, 1968, discloses a car polish, prepared by stirring and heating the ingredients until the wax components are dispersed and emulsified as fine molten (or nearly molten) particles, and cooling the resulting emulsion composition to room temperature. The emulsion is stirred rapidly while it is cooled to a temperature below the melting point of the waxes; then the emulsion is stirred slowly while it is allowed to flow from an outlet in the wall of the [mixing] vessel into the containers in which it is to be sold.

U.S. Pat. No. 1,637,475, Davis et al., Aug. 2, 1927, discloses a wax emulsion employing as the emulsifying agent a colloidal material which is a mixture of hard and soft soaps. Heating and strong agitation of the mass are continued until the wax has been dispersed. When the dispersion has been effected, a cooling or refrigerating medium is circulated through the jacket of the vessel for the purpose of rapidly chilling the mass, while at the same time the agitation is continued. When the mass has reached a temperature of about 65° C. it is strained through cheese cloth and then allowed to cool slowly to room temperature.

U.S. Pat. No. 5,039,437, Martella et al., Aug. 13, 1991, (and U.S. Pat. No. 5,082,470, Martella et al., Jan. 21, 1992, a division thereof) disclose alkyl phenol-formaldehyde condensates additives for improving the low temperature flow properties of hydrocarbon oils. The polymer composition has a number average molecular weight of at least about 3,000 and a molecular weight distribution of at least about 1.5; in the alkylated phenol reactant the alkyl groups are essentially linear, have between 6 and 50 carbon atoms, and have an average number of carbon atoms between about 12 and 26; and not more than about 10 mole % of the alkyl groups on the alkylated phenol have less than 12 carbon atoms and not more than about 10 mole % of the alkyl groups on the alkylated phenol have more than 26 carbon atoms.

U.S. Pat. No. 4,564,460, Dorer, Jr., et al., Jan. 14, 1986, (and U.S. Pat. Nos. 4,559,155, Dec. 17, 1985, 4,565,550, Jan. 21, 1986, 4,575,526, Mar. 11, 1986, and 4,613,342, Sep. 23, 1986, divisions thereof), disclose additive combinations for improving the cold flow properties of hydrocarbon fuel compositions. The composition includes a pour point depressant which can be a hydrocarbyl-substituted phenol of the formula $(R^*)_a$—Ar—$(OH)_b$ wherein R* is a hydrocarbyl group selected from the group consisting of hydrocarbyl groups of from about 8 to about 39 carbon atoms and polymers of at least 30 carbon atoms. Ar is an aromatic moiety which can include linked polynuclear aromatic moieties represented by the general formula ar—(—Lng—ar—)$_w$—$(Q)_{mw}$ wherein w is an integer of 1 to about 20. Each Lng is a bridging linkage of the type including alkylene linkages (e.g., —$CH_2$—among others).

SUMMARY OF THE INVENTION

The invention provides a homogenized liquid pour point depressant composition, comprising (i) a pour point depressant which is a solid at room temperature and which has a number average molecular weight of at least 500, and (ii) a liquid medium in which the material of (i) is substantially insoluble at room temperature;

wherein component (i) is dispersed in component (ii).

The present invention further provides a method for homogenizing a mixture of:

(i) a material which is a solid at room temperature and which has a number average molecular weight of at least 500, and (ii) a liquid in which the material of (i) is substantially insoluble at room temperature;

comprising the steps of:

(a) heating components (i) and (ii) to a temperature at which (i) is soluble in (ii) or is molten;

(b) mixing the heated components; and (c) cooling the heated mixture to a temperature at which (i) is substantially insoluble.

DETAILED DESCRIPTION OF THE INVENTION

The present invention is a dispersion of a waxy pour point depressant in a material which is a non-solvent for the pour point depressant. The dispersion is typically homogeneous, at least on a macroscopic scale. The waxy pour point depressant is a material having a number average molecular weight of at least 500, preferably at least 700, and more preferably at least 1000, preferably up to 500,000, preferably 50,000, more preferably 5,000. The material is a solid (in the absence of added solvent) at 10° C., preferably also at room temperature, that is, at least up to about 20° C., and more preferably up to 30° or 40° C. or higher. The material is further one which functions as a pour point depressant when admixed in a wax-containing hydrocarbon liquid, as measured by ASTM D-97. Suitable materials are often oligomers and often contain at least one hydrocarbyl group per molecule containing at least 12 carbon atoms.

The present invention encompasses many types of pour point depressants. Among these are pour point depressants which comprise the reaction product of (a) a hydrocarbyl-substituted phenol having sufficient carbon atoms in the hydrocarbyl-substituent that the product is a solid or semi-solid at room temperature, typically a "waxy" material, and (b) an aldehyde of 1 to 12, preferably 1 to 4, carbon atoms, or a source therefor.

Hydrocarbyl-substituted phenols are known materials, as is their method of preparation. When the term "phenol" is used herein, it is to be understood that this term is not generally intended to limit the aromatic group of the phenol to benzene (unless the context so indicates, for instance, in the Examples), although benzene may be the preferred aromatic group. Rather, the term is to be understood in its broader sense to include hydroxy aromatic compounds in general, for example, substituted phenols, hydroxy naphthalenes, and the like. Thus, the aromatic group of a "phenol" can be mononuclear or polynuclear, substituted, and can include other types of aromatic groups as well.

The aromatic group of the hydroxyaromatic compound can thus be a single aromatic nucleus such as a benzene nucleus, a pyridine nucleus, a thiophene nucleus, a 1,2,3,4-tetrahydronaphthalene nucleus, etc., or a polynuclear aromatic moiety. Such polynuclear moieties can be of the fused type; that is, wherein pairs of aromatic nuclei making up the aromatic group share two points, such as found in naphthalene, anthracene, the azanaphthalenes, etc. Polynuclear aromatic moieties also can be of the linked type wherein at least two nuclei (either mono or polynuclear) are linked through bridging linkages to each other. Such bridging linkages can be chosen from the group consisting of carbon-to-carbon single bonds between aromatic nuclei, ether linkages, keto linkages, sulfide linkages, polysulfide linkages of 2 to 6 sulfur atoms, sulfinyl linkages, sulfonyl linkages, methylene linkages, alkylene linkages, di-(lower alkyl) methylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in the aromatic group between aromatic nuclei. For example, a fluorene nucleus has two benzene nuclei linked by both a methylene linkage and a covalent bond. Such a nucleus may be considered to have 3 nuclei but only two of them are aromatic. Normally, the aromatic group will contain only carbon atoms in the aromatic nuclei per se, although other non-aromatic substitution, such as in particular short chain alkyl substitution can also be present. Thus methyl, ethyl, propyl, and t-butyl groups, for instance, can be present on the aromatic groups, even though such groups may not be explicitly represented in structures set forth herein.

Specific examples of single ring aromatic moieties are the following:

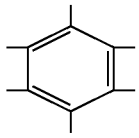

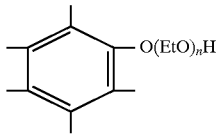

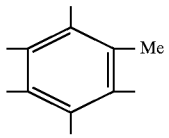

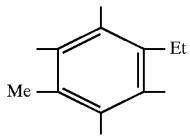

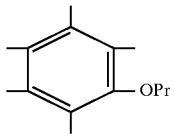

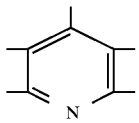

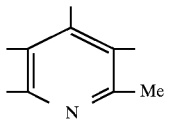

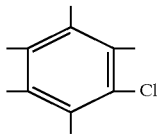

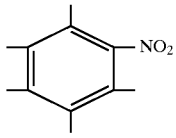

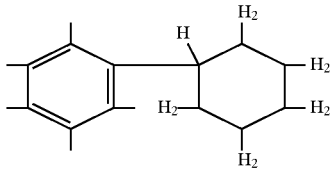

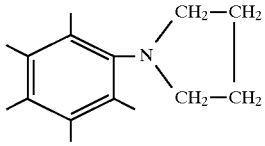

-continued

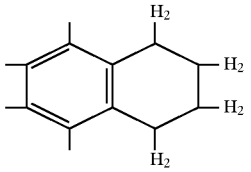

etc., wherein Me is methyl, Et is ethyl or ethylene, as appropriate, and Pr is n-propyl.

Specific examples of fused ring aromatic moieties are:

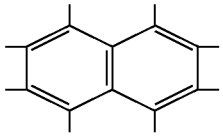

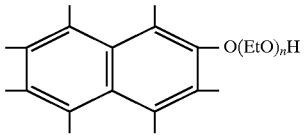

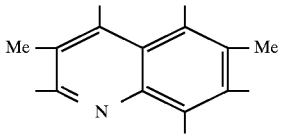

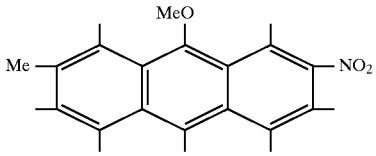

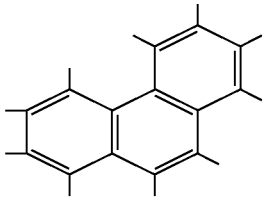

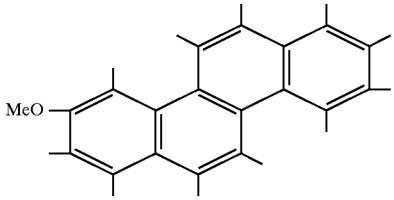

etc.

When the aromatic moiety is a linked polynuclear aromatic moiety, it can be represented by the general formula $$ar(—L—ar—)_w$$

wherein w is an integer of 1 to about 20, each ar is a single ring or a fused ring aromatic nucleus of 4 to about 12 carbon atoms and each L is independently selected from the group consisting of carbon-to-carbon single bonds between ar nuclei, ether linkages

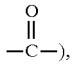

sulfide linkages (e.g., —S—), polysulfide linkages of 2 to 6 sulfur atoms (e.g., $—S—_{2-6}$), sulfinyl linkages (e.g., —S(O)—), sulfonyl linkages (e.g., $—S(O)_2—$), lower alkylene linkages (e.g., $—CH_2—$, $—CH_2—CH_2—$,

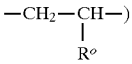

mono(lower alkyl)-methylene linkages (e.g., $—CHR^o—$), di(lower alkyl)-methylene linkages (e.g., $—CR^o{}_2—$), lower alkylene ether linkages (e.g., $—CH_2O—$, $—CH_2O—CH_2—$, $—CH_2—CH_2O—$, $—CH_2CH_2OCH_2CH_2—$,

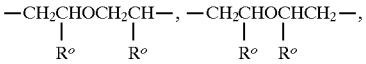

etc.), lower alkylene sulfide linkages (e.g., wherein one or more —O—'s in the lower alkylene ether linkages is replaced with a S atom), lower alkylene polysulfide linkages (e.g., wherein one or more —O— is replaced with a $—S_{2-6}$-group), amino linkages (e.g.,

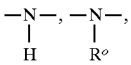

$—CH_2NCH_2—$, —alk—N—, where alk is lower alkylene, etc.), polyamino linkages (e.g., $—N(alkN)_{1-10}$, where the unsatisfied free N valences are taken up with H atoms or $R^o$ groups), linkages derived from oxo- or keto-carboxylic acids (e.g.)

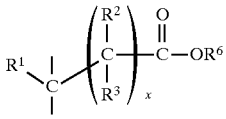

wherein each of $R^1$, $R^2$ and $R^3$ is independently hydrocarbyl, preferably alkyl or alkenyl, most preferably lower alkyl, or H, $R^6$ is H or an alkyl group and x is an integer ranging from 0 to about 8, and mixtures of such bridging linkages (each $R^o$ being a lower alkyl group).

Specific examples of linked moieties are:

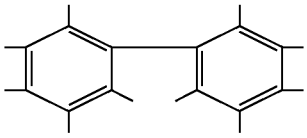

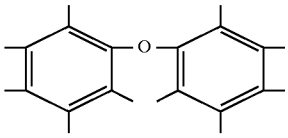

-continued

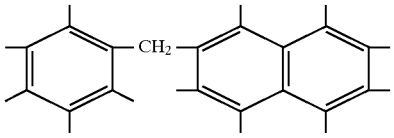

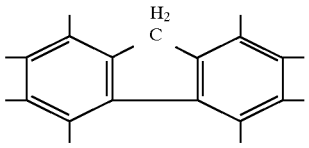

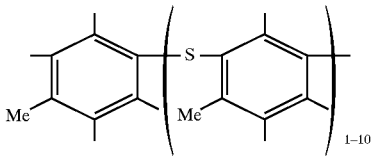

1–10

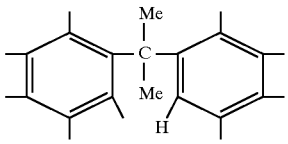

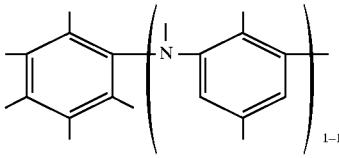

1–10, *etc.*

Usually all of these Ar groups have no substituents except for those specifically named. For such reasons as cost, availability, performance, etc., the aromatic group is normally a benzene nucleus, a lower alkylene bridged benzene nucleus, or a naphthalene nucleus. Most preferably the aromatic group is a benzene nucleus.

This first reactant is a hydroxyaromatic compound, that is, a compound in which at least one hydroxy group is directly attached to an aromatic ring. The number of hydroxy groups per aromatic group will vary from 1 up to the maximum number of such groups that the hydrocarbyl-substituted aromatic moiety can accommodate while still retaining at least one, and preferably at least two, positions, at least some of which are preferably adjacent (ortho) to a hydroxy group, which are suitable for further reaction by condensation with aldehydes (described in detail below). Thus most of the molecules of the reactant will have at least two unsubstituted positions. Suitable materials can include, then, hydrocarbyl-substituted catechols, resorcinols, hydroquinones, and even pyrogallols and phloroglucinols. Most commonly each aromatic nucleus, however, will bear one hydroxyl group and, in the preferred case when a hydrocarbyl substituted phenol is employed, the material will contain one benzene nucleus and one hydroxyl group. Of course, a small fraction of the aromatic reactant molecules may contain zero hydroxyl substituents. For instance, a minor amount of non-hydroxy materials may be present as an impurity. However, this does not defeat the spirit of the inventions, so long as the starting material is functional and contains, typically, at least one hydroxyl group per molecule.

The hydroxyaromatic reactant is similarly characterized in that it is hydrocarbyl substituted. The term "hydrocarbyl substituent" or "hydrocarbyl group" is used herein in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Preferably the hydrocarbyl group is an alkyl group. Preferably the alkyl group will contain at least 12, more preferably at least 20, and still more preferably at least 30 carbon atoms, or if the alkyl group is a mixture of alkyl groups, the mixture will preferably contain on average at least 30 carbon atoms, typically 31 to 400 carbon atoms, preferably 31 to 60, and more preferably 32 to 50 or 45 carbon atoms, although this is not required. In a preferred embodiment, the alkyl group in the composition will be a mixture of alkyl groups, which may vary in length from one particular molecule to another. While a fraction of such molecules may contain an alkyl group of fewer than 30 carbon atoms, the composition as a whole would normally be characterized as having alkyl substitution of at least 30 carbon atoms in length. For certain embodiments of the present invention the alkyl group can be shorter, containing fewer than 30 carbon atoms, e.g., predominantly 24 to 28 carbon atoms or 20–24 carbon atoms. The alkyl groups, in any case, can be derived from either linear or branched olefin reactants; linear are sometimes preferred, although the longer chain length materials tend to have increasing proportions of branching. A certain amount of branching appears to be introduced via a rearrangement mechanism during the alkylation process as well.

In a preferred embodiment, the hydrocarbyl groups employed comprise a mixture of alkyl lengths of predominantly 30 to 36 carbon atoms, having a number average carbon number of about 34.4 and a weight average carbon number of about 35.4 This material is characterized as having approximately the following chain length distribution:

| | | | |
|---|---|---|---|
| $C_{26}$ | 0.3% | $C_{40}$ | 3.8 |
| $C_{28}$ | 11.9 | $C_{42}$ | 2.9 |
| $C_{30}$ | 16.7 | $C_{44}$ | 2.3 |
| $C_{32}$ | 11.3 | $C_{46}$ | 1.8 |
| $C_{34}$ | 8.6 | $C_{48}$ | 1.5 |
| $C_{36}$ | 6.6 | $C_{50}$ | 1.4 |
| $C_{38}$ | 5.0 | $C_{52}$ | 1.3 |

The hydrocarbyl substituent thus contains a number average number of greater than 30 carbon atoms. Such substituents are preferably alkyl groups wherein the number average number of carbon atoms in the alkyl chain is 31–40, more preferably 32–38.

The hydrocarbyl group can be derived from the corresponding olefin; for example, a $C_{26}$ alkyl group is derived from a $C_{26}$ alkene, preferably a 1-alkene, a $C_{34}$ alkyl group is derived from a $C_{34}$ alkene, and mixed length groups are derived from the corresponding mixture of olefins. When the hydrocarbyl group is a hydrocarbyl group having at least 30 carbon atoms, however, it is frequently an aliphatic group (or a mixture of such groups) made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. For suitable use as a pour point depressant, at least a portion of the alkyl group or groups is preferably straight chain, that is, substantially linear. It is believed that this feature is preferred in order to permit the chain to more favorably interact with the chain structure of wax-forming hydrocarbons. It is recognized that in many cases there will be a methyl branch at the point of attachment of the alkyl chain to the aromatic ring, even when an α-olefin is employed. This is considered to be within the scope of the meaning of straight chain or linear alkyl groups. Likewise, in some cases a fraction of the alkyl groups may contain lower alkyl branching at the point of attachment (or α position) presumably due to migration of the active site during the alkylation reaction. Typically, the olefins employed are 1-mono olefins such as homopolymers of ethylene. These aliphatic hydrocarbyl groups can also be derived from halogenated (e.g., chlorinated or brominated) analogs of such homo- or interpolymers. Such groups can, however, be derived from other sources, such as monomeric high molecular weight alkenes (e.g., 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly(ethylene) greases) and other sources known to those skilled in the art. Any unsaturation in the hydrocarbyl groups may be reduced or eliminated by hydrogenation according to procedures known in the art. Preparation by routes or using materials which are substantially free from chlorine or other halogens is sometimes preferred for environmental reasons.

In one embodiment, a portion of the hydrocarbyl groups are derived from polybutene. In another embodiment, a portion of the hydrocarbyl groups are derived from polypropylene. In a preferred embodiment, the hydrocarbyl group is derived from a mixture of substantially unbranched olefins, having chain lengths predominantly of 30–36 carbon atoms, as described above.

More than one such hydrocarbyl group can be present, but usually no more than 2 or 3 are present for each aromatic nucleus in the aromatic group. Most typically only 1 hydrocarbyl group is present per aromatic moiety, particularly where the hydrocarbyl-substituted phenol is based on a single benzene ring.

The attachment of a hydrocarbyl group to the aromatic moiety of the first reactant of this invention can be accomplished by a number of techniques well known to those skilled in the art. One particularly suitable technique is the Friedel-Crafts reaction, wherein an olefin (e.g., a polymer containing an olefinic bond), or halogenated or hydrohalogenated analog thereof, is reacted with a phenol in the presence of a Lewis acid catalyst. Methods and conditions for carrying out such reactions are well known to those skilled in the art. See, for example, the discussion in the article entitled, "Alkylation of Phenols" in "Kirk-Othmer Encyclopedia of Chemical Technology", Third Edition, Vol. 2, pages 65–66, Interscience Publishers, a division of John Wiley and Company, N.Y. Other equally appropriate and convenient techniques for attaching the hydrocarbon-based group to the aromatic moiety will occur readily to those skilled in the art.

The second component which reacts to form the pour point depressant as described above is an aldehyde of 1 to 12 carbon atoms, or a source therefor. Suitable aldehydes have the general formula RC(O)H, where R is preferably hydrogen or a hydrocarbyl group, as described above, although R can include other functional groups which do not interfere with the condensation reaction (described below) of the aldehyde with the hydroxyaromatic compound. This aldehyde preferably contains 1 to 12 carbon atoms, more preferably 1 to 4 carbon atoms, and still more preferably 1 or 2 carbon atoms. Such aldehydes include formaldehyde, acetaldehyde, propionaldehyde, butyraldehyde, isobutyraldehyde, pentanaldehyde, caproaldehyde, benzaldehyde, and higher aldehydes. Monoaldehydes are preferred. The most preferred aldehyde is formaldehyde, which can be supplied as a solution, but is more commonly used in the polymeric form, as paraformaldehyde. Paraformaldehyde may be considered a reactive equivalent of, or a source for, an aldehyde. Other reactive equivalents may include hydrates or cyclic trimers of aldehydes.

The hydrocarbyl phenol and the aldehyde are reacted in relative amounts ranging from approximately equal molar amounts to about a 30% molar excess of the aldehyde (calculated based on aldehyde monomer). Preferably the amount of the aldehyde is 5 to 20, more preferably 8 to 15, percent greater than the hydrocarbyl phenol on a molar basis. The components are reacted under conditions to lead to oligomer or polymer formation. The molecular weight of the product will depend on features including the equivalent ratios of the reactants, the temperature and time of the reaction, and the impurities present. The product can have from 2 to 50 aromatic units repeating in its chain, preferably 3 to 30 such units, more preferably 4 to 14 units. When the hydrocarbyl phenol is specifically an alkyl phenol having 24–28 carbon atoms in the alkyl chain, and when the aldehyde is formaldehyde, the material will preferably have a number average molecular weight of 1,000 to 24,000, more preferably 2,000 to 18,000, still more preferably 3,000 to 6,000. The molecular weights of materials based on a hydrocarbyl substituent length of about 34 carbon atoms would be proportionally somewhat higher.

The hydrocarbyl phenol and the aldehyde are reacted by mixing the alkylphenol and the aldehyde in an appropriate amount of diluent oil or, optionally, another solvent such as an aromatic solvent, e.g., xylene, in the presence of an acid such as sulfuric acid, a sulfonic acid such as an alkylphenylsulfonic acid, para-toluene sulfonic acid, or methane sulfonic acid, an organic acid such as glyoxylic acid, or Amberlyst® catalyst, a solid, macroporous, lightly crosslinked sulfonated polystyrene-divinylbenzene resin catalyst from Rohm and Haas. The mixture is heated, generally to 90° to 160° C., preferably 100° to 150° or to 120° C., for a suitable time, such as 30 minutes to 6 hours, preferably 1 to 4, hours, to remove water of condensation. The time and temperature are correlated so that reaction at a lower temperature will generally require a longer time, and so on. Determining the exact conditions is within the ability of the person skilled in the art. If desired, the reaction mixture can thereafter be heated to a higher temperature, e.g., 140°–180° C., preferably 145°–155° C., to further drive off volatiles and move the reaction to completion. The product can be treated with base such as NaOH if desired, in order to neutralize the strong acid catalyst and to prepare a sodium salt of the product, if desired, and is thereafter isolated by conventional techniques such as filtration, as appropriate.

The product of this reaction can be generally regarded as comprising polymers or oligomers having the following repeating structure:

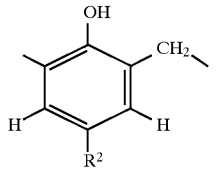

and positional isomers thereof. However, a portion of the formaldehyde which is preferably employed is believed to be incorporated into the molecular structure in the form of substituent groups and linking groups such as those illustrated by the following types, including ether linkages and hydroxymethyl groups:

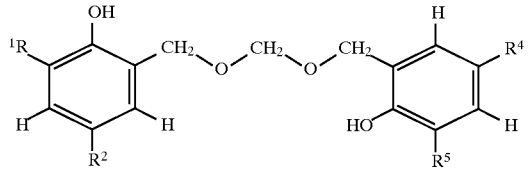

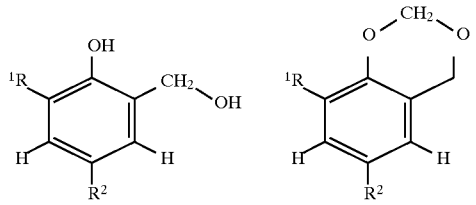

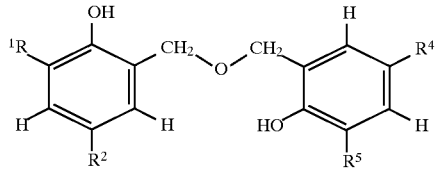

Other types of waxy pour point depressants are also suitable for use in the context of the present invention. One exemplary class is alpha olefin/acylating agent copolymers esterified with fatty alcohols. The olefin which is a comonomer in such copolymers is one or more alpha-olefin (sometimes referred to as mono-1-olefins) or isomerized alpha-olefins. Examples of alpha-olefins in general include ethylene, propylene, butylene, 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-henicosene, 1-docosene, 1-tetracosene, etc. Commercially available alpha-olefin fractions that may be used include the $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{16-20}$ alpha-olefins, $C_{22-28}$ alpha-olefins, etc. In one embodiment, the olefins are $C_{16}$ and $C_{16-18}$ alpha-olefins. Additionally, $C_{30}$+ alpha-olefin fractions such as those available from Gulf Oil Company under the name Gulftene can be used. In a preferred embodiment, the alpha olefins are in the range of $C_{16}$ to $C_{30}$ and above.

The procedures for the preparation of olefins are well known to those of ordinary skill in the art and are described in detail under the heading "Olefins" in the *Encyclopedia of Chemical Technology,* Second Edition, Kirk and Othmer, Supplement, Pages 632,657, Interscience Publishers, Div. of John Wiley and Son, 1971.

The other component of the copolymer is a copolymerizable acylating agent. An acylating agent is a material which will react with an alcohol to form an ester; typically it is an acid, an ester, or preferably a more reactive equivalent such as an acyl halide or an anhydride. Both monocarboxylic and polycarboxylic acylating agents are included. Particularly preferred are the dicarboxylic acylating agents such as the succinic acylating agents. These include succinic acids, halides, esters, and anhydrides, preferably, acids, esters or anhydrides, more preferably anhydrides.

The copolymer is esterified with one or more fatty alcohols. Fatty alcohols are synonymous with alkyl hydroxy compounds, especially straight chain alkyl hydroxy compounds, and most especially those comprising at least 6, preferably at least 12 or 18, carbon atoms. Preferred fatty alcohols contain 16 to 30 carbon atoms. Examples of fatty alcohols include caprylyl alcohol, pelargonyl alcohol, lauryl alcohol, myristyl alcohol, palmityl alcohol, margaryl alcohol stearyl alcohol, arachidic alcohol, behenyl alcohol, cerotyl alcohol, commercial and mixtures of alcohols having, e.g., 8–12 carbon atoms, 16–20 carbon atoms, and so on.

One exemplary pour point depressant of the above-described type is the behenyl alcohol diester of the copolymer of $C_{20-24}$ α-olefin and maleic anhydride (1:1 mole).

Other types of waxy pour point depressant which are suitable for use in the present invention include ester-containing polymers or oligomers, including ethylene/vinyl acetate copolymers, particularly those with a melt index of less than 100 (ASTM 1238 condition E) and including also polymers which comprise acrylate or methacrylate monomers; ester polymers of fatty alcohols, such as vinyl carboxylate/dialkylfumarate copolymers, particularly vinyl acetate/$C_{16-30}$ alkyl fumarates, prepared from fatty alcohols; poly(methyl acrylate) or poly(methyl methacrylate), transesterified with fatty alcohols having 16 to 30 carbon atoms to form the long chain esters; similar polymers made by esterifying acrylic acid with $C_{16-30}$ alcohols and thereafter conducting the polymerization; and styrene/maleic anhydride copolymers, esterified with $C_{16-30}$ fatty alcohols. Certain poly alpha olefins can also be employed as pour point depressants. Also included are alkylated naphthalenes, including those made by the reaction of chlorowaxes and alpha olefins with naphthalenes. These and other types of waxy pour point depressants are well known to those skilled in the art and are generally available as articles of commerce.

The pour point depressant of the present invention is supplied as dispersions in a liquid medium in which it is not normally soluble at 10° C., and preferably also not soluble at room temperature, i.e., about 20° C., or even 30° or 40° C. That is, the medium is, first, a liquid a room temperature (about 20° C.) and will preferably have a freezing point of 10° C. or below. Some preferred media, in particular, mixtures, will have a freezing point of as low as 0° C., −20° C., −30° C., −40° C. or below. Moreover, the medium will not dissolve a substantial amount of the pour point depressant at such temperatures, preferably, room temperature. More specifically, the medium will preferably dissolve less than 4 weight percent, preferably less than 2 or even 1 weight percent, of the pour point depressant at room temperature or moderately elevated temperatures. (In some cases the small soluble fraction may comprise impurities and unreacted materials, so that the amount of actual pour point depressant which dissolves will be proportionately even less, e.g., less than 0.5 weight percent.) Preferably the medium will remain a non-solvent to 30° C. or preferably to 40° or 50° C. or higher.

In order for the liquid medium to be a nonsolvent for the waxy pour point depressant, the medium should generally have a suitable degree of polarity. Polarity can be measured or expressed in a variety of ways. Thus in one embodiment the molecules of the solvent will preferably have 10 to 80 percent by weight heteroatoms such as oxygen or nitrogen, more preferably 20 to 70 percent, and still more preferably 25 to 60 percent by weight. Alternatively, the medium may have a dielectric constant of at least 3, preferably at least 10. The aforementioned parameters would normally be those of the medium as a whole, including, if it is a mixture, all the components as mixed.

Suitable liquid media include acetates (e.g., 2-ethoxyethyl acetate, also known as Cellosolve® acetate), ketones (e.g., acetone, butanone, pentanone, hexanone), or aqueous glycol mixtures (e.g., mixtures of ethylene glycol and water). Among the materials which can be used alone or in combination with water are ethylene glycol and its derivatives, such as the monomethyl ether (Methyl Cellosolve®), the monoethyl ether (Cellosolve®), the monopropyl ether, monobutyl ether, and monohexyl ether; diethylene glycol and its derivatives, such as the monomethyl ether (Methyl Carbitol®), the monoethyl ether (Carbitol®), monopropyl ether, monobutyl ether, and monohexyl ether; propylene glycol and its derivatives, including the monomethyl ether (Methyl Propasol®), the monopropyl ether, and the monobutyl ether; and dipropylene glycol and its derivatives, such as the monomethyl ether (Methyl Dipropasol®), the monopropyl ether, and the monobutyl ether.

Other suitable types of materials include lactones such as butyrolactone, and alcohols such as butanol, diacetone alcohol (4-hydroxy-4-methyl-2-pentanone) 2,6-dimethyl-4-heptanol (Diisobutyl Carbinol®), hexanol, isopropanol, 2-ethylhexanol, and 1-pentanol.

The liquid material can also be a mixture of any of the foregoing materials, including mixtures with water, although the waxy pour point depressant should similarly be substantially insoluble in such mixture. If the liquid material is a mixture of a glycol and water, the relative amounts of the materials are such that the water component will not freeze even at low temperatures such as 0° to −40° C. Weight ratios of about 1:1 for such aqueous mixtures are often preferred, more generally ratios of 1:2 to 2:1, preferably 1:1.5 to 1.5:1 are satisfactory.

Many waxy pour point depressants are conventionally supplied in concentrate form, containing variable amounts of aromatic solvents such as xylenes or a commercial mixed aromatic solvent having a boiling point of about 179° C. The presence of a modest amount of such solvents (e.g., 10% to 50%, e.g., 25%, based on the weight of the pour point depressant/solvent mixture) has been found to sometimes aid in the dispersion of the pour point depressant in the medium, although its presence is not required. If such aromatic solvent is present, it will be considered as a component of the liquid medium and will contribute to the total amount and solvent character (polarity) the medium.

The dispersed composition preferably also contains a dispersant to aid in forming and maintaining the dispersion. Dispersants, also known as surfactants, can be classified as anionic, cationic, zwitterionic, or non-ionic. Anionic surfactants include substances containing a long lipophilic tail bonded to a water-soluble (hydrophilic) group at the other end, wherein the hydrophilic group contains an anionic moiety such as a carboxylic acid, sulfonic acid, or phenolic group, neutralized by a cation such as an alkali metal or ammonium. The lipophilic tail is preferably an alkyl group, typically having about 8 to about 21 carbon atoms.

Typical anionic surfactants include carboxylic acid salts such as fatty acid salts having the formula $R_1COOR_2$ wherein $R_1$ is a straight chain, saturated or unsaturated, hydrocarbon radical of about 8 to about 21 carbon atoms and $R_2$ is a base-forming radical such as Li, Na, K, or $NH_4$ which makes the detergent-like surfactant soluble in water or increases the affinity of the surfactant to water. Alternatively $R_2$ may be a divalent or polyvalent metal, in which case the appropriate number of acid groups are normally present in order to provide the neutral salt. Multiply valent metal ions include Mg, Ca, Sr, Ba, Cr, Mn, Fe, Co, Ni, Cu, Zn, Sn, Pb, and others. Typical fatty acid salts include sodium stearate, sodium palmitate, ammonium oleate, and triethanolamine palmitate. Additional carboxylic acid salts useful as anionic surfactants include salts, and especially sodium and potassium salts, of coconut oil fatty acids and tall oil acids as well as other carboxylic acids salt compounds including amine salts such as triethanolamine salts, acylated polypeptides, and salts of N-lauryl sarcosine such as N-dodecanoyl-N-methylglycine sodium salt.

Other anionic surfactants include aryl and alkyl aryl sulfonates such as alkylbenzene sulfonate, linear alkylbenzene sulfonates, sodium tetrapropylene benzene sulfonate, sodium dodecylbenzene sulfonate, benzene-, toluene-, xylene-, and cumene sulfonates, lignin sulfonates, petroleum sulfonates, paraffin sulfonates, secondary n-alkanesulfonates, α-olefin sulfonates, alkylnaphthalene sulfonates, n-acyl-n-alkyltaurates, sulfosuccinate esters, isothionates, alkyl sulfates having the formula $R_1OSO_3R_2$ wherein $R_1$ and $R_2$ are defined above, such as lithium dodecyl sulfate, sodium dodecyl sulfate, potassium dodecyl sulfate, and sodium tetradecyl sulfate, alkyl sulfonates having the formula $R_1SO_3R_2$ wherein $R_1$ and $R_2$ are as defined above, such as sodium lauryl sulfonate, sulfated and sulfonated amides and amines, sulfated and sulfonated esters such as lauric monoglyceride sodium sulfate, sodium sulfoethyl oleate, and sodium lauryl sulfoacetate, sulfuric acid ester salts such as sulfated linear primary alcohols, sulfated polyoxyethylenated straight chain alcohols and sulfated triglyceride oils, phosphoric and polyphosphoric acid esters, perfluorinated carboxylic acids, and polymeric anionic surfactants such as alginic acids.

Also included are polymeric anionic surfactants such as salts of polymers of alkyl acrylates and/or alkyl methacrylates and acrylic and/or methacrylic acid, and salts of partial esters of maleic anhydride-styrene copolymers.

Another group of materials which can be classified as anionic surfactants are those materials known as overbased or superbased materials. These are basic metal salts, preferably alkali or alkaline earth metal salts, of acidic organic compounds (carboxylic acids, sulfonic acids, phosphonic acids, phenols, and so on). Overbased materials are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a phenol or alcohol. The acidic organic material will normally have a sufficient number of carbon atoms to provide a degree of solubility in oil and to provide a measure of surfactant activity to the product. The amount of excess metal is commonly expressed in terms of metal ratio. The term "metal ratio" is the ratio of the total equivalents of the metal to the equivalents of the acidic organic compound: a neutral metal salt has a metal ratio of one; a salt having 4.5 times as much metal as present in a normal salt will have metal excess of 3.5 equivalents, or a ratio of 4.5.

Overbased materials are commonly used as lubricant additives and are well known to those skilled in the art. While they are useful for some applications, the scope of their utility may be different from that of other surfactants. That is, they have been observed occasionally to deposit what is believed to be calcium carbonate after exposure to an electric field. Nevertheless in situations where this is not a problem their use can be appropriate and they are accordingly considered to be within the scope of the present invention. Patents describing techniques for making basic salts of sulfonic acids, carboxylic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

Cationic surfactants are similar to anionic surfactants except that the surface-active portion of the molecule has a positive charge. Examples of cationic surfactants include long-chain amines and their salts, such as primary amines derived from animal and vegetable fatty acids and tall oil and synthetic $C_{12}$–$C_{18}$ primary, secondary, or tertiary amines; diamines and their salts, quaternary ammonium salts including tetraalkylammonium salts and imidazolinium salts derived from e.g. tallow or hydrogenated tallow, or N-Benzyl-N-alkyldimethylammonium halides; polyoxyethylenated long-chain amines; quaternized polyoxyethylenated long-chain amines; and amine oxides such as N-alkyldimethylamine oxides (which are actually zwitterionic) such as cetyl dimethylamine oxide or stearyl dimethylamine oxide.

Zwitterionic surfactants include amino acids such as β-N-alkylamino-propionic acids, N-alkyl-β-iminodipropionic acids, imidazoline carboxylates, N-alkylbetaines, sulfobetaines, and sultaines.

Nonionic surfactants, which are preferred for the present invention, are similar materials in which the polar functionality is not provide by an anionic or cation group, but by a neutral polar group such as typically an alcohol, amine, ether, ester, ketone, or amide function. Typical nonionic surfactants include polyoxyethylenated alkylphenols such as polyoxyethylenated p-nonylphenol, p-octylphenol, or p-dodecylphenol, polyoxyethylenated straight-chain alcohols derived from coconut oil, tallow, or synthetic materials including oleyl derivatives; polyoxyethylenated polyoxypropylene glycols (block copolymers of ethylene oxide and propylene oxide), typically having molecular weights of 1000 to 30,000; polyethylene glycol; polyoxyethylenated mercaptans; long-chain carboxylic acid esters including glyceryl and polyglyceryl esters of natural fatty acids, propylene glycol esters, sorbitol esters, polyoxyethylenated sorbitol esters, polyoxyethylene glycol esters, and polyoxyethylenated fatty acids; alkanolamine "condensates" e.g. the condensates made by reaction of methyl or triglyceride esters of fatty acids with equimolar or twice equimolar amounts of alkanolamine; tertiary acetylenic glycols; polyoxyethylenated silicones, prepared by reaction of a reactive silicone intermediate with a capped allyl polyalkylene oxide such as propylene oxide or mixed ethylene oxide/propylene oxide copolymer; N-alkylpyrrolidones, and alkylpolyglycosides (long chain acetals of polysaccharides). Many of these and other ionic and non-ionic surfactants are discussed in Rosen, "Surfactants and Interfacial Phenomena," John Wiley & Sons, pp. 7–31, 1989.

Certain materials which are normally characterized as nonionic surfactants may bear a similarity to certain of the liquid media, described above. Should a distinction between these components be required, a material can be classified as a nonionic surfactant for the purposes of this invention if it exhibits the characteristics of a nonionic surfactant and further is a solid at room temperature, preferably even at 30° C. or 40° C. Materials which are liquids at these temperatures, particularly at room temperature and below, can be classified, rather, as a component of the liquid medium.

Further nonionic surfactants more specifically include ethoxylated coco amide, oleic acid, t-dodecyl mercaptan, modified polyester dispersants, ester, amide, or mixed ester-amide dispersants based on polyisobutenyl succinic anhydride, dispersants based on polyisobutyl phenol, ABA type block copolymer nonionic dispersants, acrylic graft copolymers, octylphenoxypolyethoxyethanol, nonylphenoxypolyethoxyethanol, alkyl aryl ethers, alkyl aryl polyethers, amine polyglycol condensates, modified polyethoxy adducts, modified terminated alkyl aryl ethers, modified polyethoxylated straight chain alcohols, terminated ethoxylates of linear primary alcohols, high molecular weight tertiary amines such as 1-hydroxyethyl-2-alkyl imidazolines, oxazolines, perfluoralkyl sulfonates, sorbitan fatty acid esters, polyethylene glycol esters, aliphatic and aromatic phosphate esters. Also included are the reaction products of hydrocarbyl-substituted succinic acylating agents and amines. These reaction products and methods for preparing them are described in U.S. Pat. Nos. 4,234,435; 4,952,328; 4,938,881; and 4,957,649.

Other nonionic surfactants include functionalized polysiloxanes. These materials contain functional groups such as amino, amido, imino, sulfonyl, sulfoxyl, cyano, hydroxy, hydrocarbyloxy, mercapto, carbonyl (including aldehydes and ketones), carboxy, epoxy, acetoxy, phosphate, phosphonyl, and haloalkyl groups. These polysiloxanes can be linear or branched and generally have molecular weight above 800, i.e. up to 10,000 or 20,000. The functionality can be randomly distributed on the polymer chain or present in blocks. The functionality can be present as alkyl or alkaryl groups as well as groups such as $—(C_2H_4O)_a—(C_3H_6O)_b—R$ where a and b are independently numbers from 0 to about 100 provided that at least one of a or b is at least 1, and R is H, acetoxy, or a hydrocarbyl group. Other suitable substituent groups can include $C_3H_6X$, where X is OH, SH, or $NH_2$. Examples of such materials include Silwet® surfactants from Union Carbide and Tegopren® silicone surfactants from Goldschmidt Chemical Corp., Hopewell, Va.

Nonionic surfactants include polyoxyalkenealkyl alcohols or phenols, such as ethoxylated nonylphenol, alkanoates (preferably partial alkanoates) of polyalcohols, such as glyceryl monooleate, glyceryl monolaurate, sorbitan monooleate, sorbitan sesquioleate, sorbitan monolaurate, and sorbitan sesquilaurate, and 4,4-bishydroxylmethyl-2-heptadecenyl-2-oxazoline. Preferred materials include tall oil fatty acid neutralized with diethanolamine, Triton® surface active agents (from Rohm & Haas), including the octylphenol series with 1 to 70 ethylene oxide units and the nonylphenol series with 4 to 40 ethylene oxide units, Neodol® surfactant ethoxylates (from Shell Chemical Co.) with 2 to 13 ethylene oxide units, Igepal® surfactants (from Rhone-Poulenc) containing 7 to 50 ethylene oxide units, and Tergtitol® surfactants (from Union Carbide) containing 4 to 41 ethylene oxide units. The foregoing commercial materials are generally linear primary alcohol ethoxylates or (in the case of the Triton materials) branched alkylphenol ethoxylates.

The relative amounts of the fatty pour point depressant, the liquid medium, and the optional surfactant can vary widely, but are preferably in the range of (20–60):(40–80):(0–10), preferably (30–50):(50–70):(1–7), more preferably (35–45):(55–65):(2–6), especially about 38:58:4 parts by weight.

The dispersed composition of the present invention is prepared by first heating the components to a temperature at which the waxy material can be dispersed by suitable means in the liquid medium plus the optional surfactant, if present. This condition can be met if, at a suitably elevated temperature the waxy material is soluble in the liquid medium Normally such solubility would be determined not only by the inherent solubility characteristics of the waxy material and the solubility properties of the medium, but also the boiling point of the liquid medium. Preferably the combination of liquid medium and waxy material is such that, in this embodiment, a suitable amount of solubility, e.g., 80 g per 100 g medium, is attained at or below the normal boiling point of the medium, although increased solubility can normally be achieved, if desired, by combining the components under elevated pressure, to increase the boiling point of the medium. Alternatively, improved dispersability of the waxy material can be obtained by heating the mixture to a temperature above the melting point of the waxy material, even if the waxy material does not dissolve in the medium. More generally, the mixture is heated until the composition becomes liquid. Finally, it is possible in certain cases to obtain suitable dispersability of materials which neither dissolve nor melt at elevated temperatures provided that suitable mechanical means are employed for dispersion. The heated components, particularly if they are in a liquid (melted or dissolved) state are then mixed to assure dispersion. This mixing can be conducted under high shear or cavitation conditions. "High shear" normally will mean shear conditions of at least $10^3$ $sec^{-1}$, preferably at least $10^5$ $sec^{-1}$, and more preferably at least $10^6$ $sec^{-1}$. Cavitation conditions are also considered to be high shear conditions; cavitation generally involves formation of microscopic bubbles within a liquid, which expand under the influence of ultrasonic energy and thereafter implode with an intense shearing action. Devices capable of producing a sufficiently high shear or cavitation conditions include a Sonicator®, a high intensity ultrasonic processor, in which high frequency electrical voltage (e.g., 20 kHz) is converted to mechanical vibration energy which is directed into a liquid sample by means of a probe. Also included are high shear dispersers (such as Dispersator®) in which a high speed rotor is held in close clearance to a fixed stator, creating an environment of extremely high shear due to the mechanical and hydraulic forces as the fluid passes into the rotor and is expelled at high velocity through the stator, or a Microfluidizer® (from Microfluidics Intl. Inc.) in which two high pressure streams interact at high velocities in defined micro-channels, whereby shear, impact, and cavitation forces typically produce submicron particles. The temperature to which the composition will be heated will depend on the melting, solubility, and volatility characteristics of the materials employed; typically heating can be to 40° to 100° C., preferably 50° to 90° C., more preferably 70° to 83° C. The heated mixture is then cooled to a temperature at which the waxy material is substantially insoluble and would normally exist in a solid or semisolid state, while maintaining the conditions mixing. The resulting mixture is a stable dispersion.

In one embodiment the pour point depressant is melted and an appropriate amount of surfactant is added to the melt, with mixing. A suitable amount of similarly heated liquid medium (such as water/glycol) is added and the components mixed. The mixture is then subjected to high shear mixing or sonication either while hot and during the cooling process, or alternatively after the mixture has cooled.

Materials prepared by any of the foregoing methods can also be described as homogenized materials. That is, they are materials in which, due to the aforedescribed treatments, the particle size of the suspended material is relatively reduced and preferably relatively uniform, and the suspended particles are relatively evenly distributed throughout the medium and remain dispersed for a commercially reasonable length of time.

The dispersions of the present invention can be used to supply pour point depressant in a concentrate form to wax (paraffin)-containing hydrocarbon materials such as a crude oil or a fraction of crude oil, such as residual oil, vacuum gas oil, or vacuum residual oils (Bunker C crude oils), that is, naturally sourced and partially refined oils, including partially processed petroleum derived oils. The amount of the pour point depressant employed in the paraffin-containing liquid will be an amount suitable to reduce the pour point thereof by a measurable amount, i.e., by at least 0.6° C. (1° F.), preferably at least 2° C. (3° or 4° F.), more preferably 3° C. (5° F.), and even more preferably 6° C. (10° F.). This reduction in pour point can be readily determined by one skilled in the art by employing the methodology of ASTM D-97. Typically the amount of pour point employed, apart from the liquid medium in which it is dispersed, will be 50 to 10,000 parts per million by weight (ppm), preferably 100 to 5000 ppm, more preferably 200 to 2000 ppm, based on the fluid to which it is added. The total amount of concentrate to be supplied will be proportionally higher, depending on the concentration of the pour point depressant within the concentrate.

EXAMPLES

Example 1

Ethylene glycol, 571.5 g, and distilled water, 571.5 g, are combined with stirring and heated to about 50° C. (120° F.). Separately, 1143.0 g condensation product of formaldehyde and alkyl phenol, the alkyl substituents being predominantly $C_{30-36}$ carbons in length, as described hereinabove (50% active ingredient in 50% diluent mineral oil), and 114.3 g of a dispersant composition of 75.6 weight percent tall oil fatty acid and 24.4 weight percent diethanolamine are combined, heated until melting occurs (about 82° C., 180° F.), and thereafter mixed with sufficient shear, over a period of about 10 minutes, to produce a uniform mixture. The heated ethylene glycol/water mixture is added to the other mixture, using sufficient shear, over a course of 20 minutes.

The resulting mixture is allowed to cool, then passed twice through a Micronizer® which is set up with a "3669" interaction chamber (to produce 75 micron particles) and a 3839 back pressure module (200 microns), with the pressure set to 170 MPa (25,000 psi). The fully treated material is collected.

Example 2

To a small stainless steel beaker is charged 70.57 g of (a) a pour point depressant of styrene/maleic anhydride copolymer (1:1 mole ratio, reduced specific viscosity about 0.42), esterified using 2.2 moles behenyl alcohol, and (b) 105.86 g 2-ethoxyethyl acetate (Cellosolve® acetate). The chemicals are mixed using a laboratory Dispersator® fitted with a homogenizing head. While continuing the shear, the mixture is heated to 77° C. (170° F.) at which point the mixture becomes clear. Heating is continued to 82° C. (180° F.). Heating is discontinued and the mixture is allowed to cool, with continued shear, to room temperature.

Example 3

To a 50 mL sample of a crude oil having an unmodified pour point of −18° C. (0° F.) is added 0.05 g of the pour point depressant composition of Example 2. The resulting mixture exhibits a pour point of −46° C. (−50° F.).

Example 4

To a Pyrex® beaker on a hot plate is added 28.0 parts by weight of (a) pour point depressant prepared as in Example 2 and (b) 65.0 parts by weight of propylene glycol t-butyl ether (Arcosolve® PTB, from Arco). The chemicals are heated and mixed using a laboratory stirrer, while the mixture is heated until the pour point depressant is entirely dissolved. Heating is discontinued and the mixture is allowed to cool, with continued mixing, to room temperature.

The particle size of the pour point depressant within the mixture is further reduced by placing the mixture in a grease bar mill (comprising a steel tube and a cylindrical bar which fits therein, along with the mixture) and rolling the mixture for 1 hour.

Example 5

Example 4 is repeated except that the mixture comprises (a) 120 g of the pour point depressant of Example 1 and (b) a medium of 60 g propylene glycol, monobutyl ether, 60 g Cellosolve® acetate, and 60 g propylene glycol. Initial heating is effected until the pour point depressant melts.

Example 6

Into a Pyrex® beaker is placed (a) 15 parts by weight of a pour point depressant comprising the condensation product of formaldehyde and alkyl phenol, the alkyl substituents being predominantly $C_{30-36}$ carbons in length, as described hereinabove (50% active ingredient in 50% diluent mineral oil), and (b) 1.5 parts by weight of a dispersant composition of 75.6 weight percent tall oil fatty acid and 24.4 weight percent diethanolamine. The mixture is heated to 82° C. (180° F.), with stirring, on a hot plate, and to the mixture is slowly added a mixture of (c) 7.5 parts by weight ethylene glycol and 7.5 parts by weight water, which had been preheated to 50°–70° C. (120°–160° F.). When the addition is complete, the mixture is passed through a Microfluidizer® and allowed to cool to room temperature.

Example 7

Example 6 is repeated except in place of the alkyl phenol condensation product, component (a) is 15 parts by weight of the pour point depressant of Example 1.

Example 8

Into a Pyrex® beaker is placed (a) 15 parts by weight of a pour point depressant comprising ethylene vinyl acetate copolymer (Elvax® 150, from Du Pont, 33% vinyl acetate content, 43 melt index (ASTM D 1238-E), and (b) 1.5 parts by weight of a dispersant of 75.6 weight percent tall oil fatty acid and 24.4 weight percent diethanolamine. The mixture is heated to 82° C. (180° F.), with stirring, on a hot plate, and to the mixture is added first 7.5 parts by weight of ethylene glycol (heated to 82° C.) and thereafter 7.5 parts by weight water (heated to 71° C). When the addition is complete, the mixture is passed through a Microfluidizer® and allowed to cool to room temperature.

Example 9

Example 2 is repeated except that in place of the styrene-maleic anhydride polymer there is used a $C_{18}$ alpha olefin/maleic anhydride copolymer (1:1 mole ratio), esterified using 2.2 moles behenyl alcohol.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

I claim:

1. A homogenized liquid pour point depressant composition, comprising:

(i) a pour point depressant comprising the reaction product of (a) an alkyl-substituted phenol wherein the alkyl group contains at least about 20 carbon atoms and (b) formaldehyde or a source therefor; said pour point depressant being a solid at 10° C. and having a number average molecular weight of at least 500 and up to about 500,000, and (ii) an aqueous-glycol liquid medium in which the material of (i) is substantially insoluble at 10° C.;

wherein component (i) is dispersed in component (ii).

2. The compositions of claim 1 wherein the alkyl group contains at least about 30 carbon atoms.

3. The compositions of claim 2 wherein the alkyl group contains about 30 to 36 carbon atoms.

4. The compositions of claim 1 wherein the alkyl group contains about 24 to 28 carbon atoms.

5. The composition of claim 1 wherein the reaction product comprises 2 to about 50 repeating aromatic units.

6. The composition of claim 1 further comprising (iii) a dispersant in an amount suitable to aid in forming and maintaining the dispersion of component (i) in component (ii).

7. The composition of claim 6 wherein the dispersant is an ionic dispersant formed by the interaction of a fatty acid and an amine.

8. The composition of claim 7 wherein the dispersant is prepared from tall oil fatty acid and diethanolamine.

9. A method for homogenizing a mixture of:

(i) a pour point depressant comprising the reaction product of (a) an alkyl-substituted phenol wherein the alkyl group contains at least about 20 carbon atoms and (b) formaldehyde or a source therefor; said pour point depressant being a solid at 10° C. and having a number average molecular weight of at least 500 and up to about 500,000, and (ii) an aqueous-glycol liquid in which the material of (i) is substantially insoluble at 10° C.;

comprising the steps of:

(a) heating components (i) and (ii) to a temperature at which (i) is soluble in (ii) or is molten;

(b) mixing the heated components; and (c) cooling the heated mixture to a temperature at which (i) is substantially insoluble in the liquid of (ii).

10. The methods of claim 9 wherein the alkyl group contains at least about 30 carbon atoms.

11. The methods of claim 10 wherein the alkyl group contains about 30 to 36 carbon atoms.

12. The methods of claim 9 wherein the alkyl group contains about 24 to 28 carbon atoms.

13. The methods of claim 9 wherein the reaction product comprises 2 to about 50 repeating aromatic units.

14. The method of claim 9 wherein the mixture which is homogenized further comprises (iii) a dispersant in an amount suitable to aid in forming and maintaining a dispersion of component (i) in component (ii).

15. The method of claim 14 wherein the dispersant is an ionic dispersant formed by the interaction of a fatty acid and an amine.

16. The method of claim 15 wherein the dispersant is prepared from tall oil fatty acid and diethanolamine.

* * * * *